US007036675B2

(12) United States Patent
Forest

(10) Patent No.: US 7,036,675 B2
(45) Date of Patent: May 2, 2006

(54) TRASH RECEPTACLE AND ATTACHMENT

(76) Inventor: Robert A. Forest, 5505 N. Scarsdale Cir., Reno, NV (US) 89502

( * ) Notice: Subject to any disclaimer, the term of this patent is extended or adjusted under 35 U.S.C. 154(b) by 680 days.

(21) Appl. No.: 10/174,555

(22) Filed: Jun. 19, 2002

(65) Prior Publication Data

US 2003/0102316 A1 Jun. 5, 2003

Related U.S. Application Data

(63) Continuation of application No. 09/524,224, filed on Mar. 13, 2000, now abandoned.

(51) Int. Cl.
*B65D 1/06* (2006.01)

(52) U.S. Cl. ..... 220/495.07

(58) Field of Classification Search ..... 220/495.07, 220/23.4

See application file for complete search history.

(56) References Cited

U.S. PATENT DOCUMENTS

| | | | | |
|---|---|---|---|---|
| 4,823,979 | A * | 4/1989 | Clark, Jr. | 220/495.07 |
| 5,092,480 | A * | 3/1992 | Waterston | 220/23.4 |
| 5,115,916 | A * | 5/1992 | Beasley et al. | 206/581 |
| 5,429,262 | A * | 7/1995 | Sharkey | 220/23.83 |

* cited by examiner

*Primary Examiner*—Stephen Castellano
(74) *Attorney, Agent, or Firm*—Herman H Bains

(57) ABSTRACT

A trash can or receptacle is provided with a container which contains a supply of flexible bags used as a liner for the receptacle. In certain embodiments of the container, the container is permanently attached to the trash receptacle, and in other embodiments the container is detachably connected to the trash receptacle. In certain embodiments of the container, the container is configured to hold a roll of flexible bags which are dispensed through a dispensing slot. In other embodiments of the container, the container is configured to hold a supply of folded flexible bags.

3 Claims, 3 Drawing Sheets

TRASH RECEPTACLE AND ATTACHMENT

This application is a continuation of Ser. No. 09/524,224 filed Mar. 13, 2000, now abandoned.

This invention relates to a trash receptacle and more particularly to a trash receptacle having a trash bag container secured thereto. The specification in my copending application Ser. No. 09/524,224, filed Jul. 16, 2001 is incorporated in its entirety by reference.

FIELD OF THE INVENTION

Background of the Invention

Users of conventional household trash receptacles usually line the interior of the receptacle with a flexible trash bag for convenience in removing the contents of the trash receptacle. The flexible trash bags are commercially available and are usually sold in packages. The user must remove a flexible trash bag from the package and apply the flexible trash bag to the interior of the receptacle. The package containing the flexible trash bags is usually remote from the receptacle.

SUMMARY OF THE INVENTION

An object of this invention is to provide a trash receptacle having a trash bag container secured thereto, the trash bag container containing a supply of flexible trash bags for use in lining the interior of the trash receptacle. In certain embodiments, the trash bag container is secured to a vertical wall of the receptacle by a welding (epoxy) or a suitable adhesive. In other embodiments, the receptacle has an opening in a vertical wall thereof, and the container has outturned flanges which engage peripheral edges defining the opening. In further embodiments, the container is secured to the upper edges of the receptacle by hook elements. Finally, in another embodiment, the container comprises a drawer which is slidable into and out of a compartment defined by the bottom wall and a false bottom of the receptacle.

DETAILED DESCRIPTION OF THE PREFERRED EMBODIMENT

Figure 1:
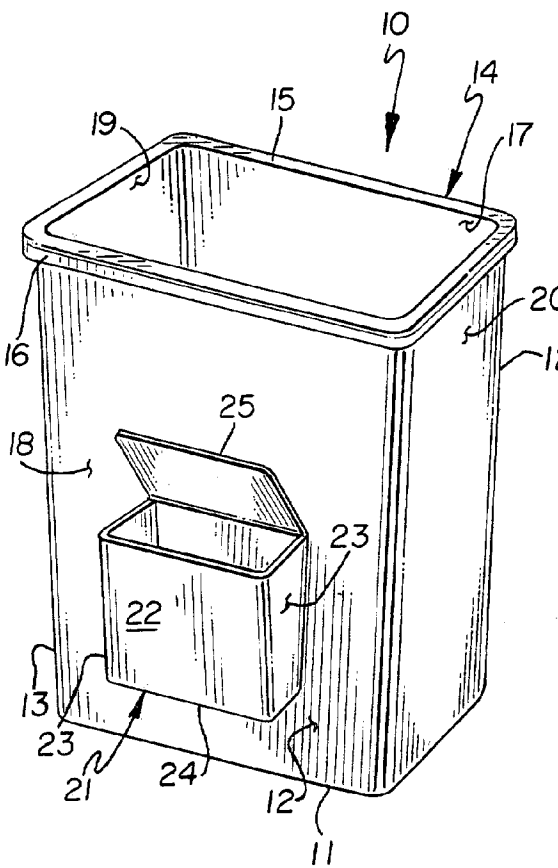
FIG. 1 is a perspective view of the novel trash receptacle and trash bag container(s)

Referring now to the drawings, and more particularly to FIG. 1, it will be seen that one embodiment of my novel trash receptacle and trash bag container designated generally by the reference numeral 10 is thereshown. The trash can or receptacle 10 is of conventional construction and, in the embodiment shown, is open top rectangular (parallelepiped) configuration. It will be appreciated that the trash receptacle may have other configurations such as cylindrical, slightly frustoconical or other shapes. The trash receptacle 10 is formed of a rigid material such as a polymer or the like. The trash receptacle has a substantially flat bottom wall 11 which is integral with a vertical wall structure. The vertical wall structure is comprised of opposed flat side walls 12 and opposed flat end walls 13.

The vertical wall structure terminates upwardly in an upper peripheral edge 14 which includes an outturned flange 15 and a downturned flange 16. The side walls 12 each has a substantially flat interior surface 17 and a substantially flat exterior surface 18. Each end wall 13 has a flat interior surface 19 and a flat exterior surface 20.

A generally rectangular shaped container 21 is secured to the exterior surface 18 of one of the sidewalls 12. In the embodiment shown, the container 21 is secured to the side wall 12 of the trash receptacle by a suitable adhesive material such as an epoxy or similar cementitous material.

The container 21 is of generally rectangular configuration and includes side walls 22, end walls 23, bottom wall 24 and a lid 25 hingedly connected to a side wall 22. It will be noted that the container 21 opens upwardly and is of a shape and size to contain a supply of folded flexible bags. Thus a user can remove a flexible bag from the container 21 and readily apply the bag to the trash receptacle 10 as a liner.

Referring again to FIG. 1, it will be seen that the receptacle 10 also has another container 26 secured to an end wall thereof. However, it is pointed out that a trash receptacle 10 will typically have only a single container attached thereto. The container 26 is secured to the end wall by a suitable cementitous material including epoxy or may be heat welded to the receptacle. The container 26 is of semicylindrical configuration and includes a flat bottom wall 27, a semicylindrical vertical wall 28, a flat rear wall 29, and a lid 30 is hingedly connected to the rear wall 29. The container 26 is shaped and sized to contain a commercially available roll of flexible bags which will dispensed through a vertically extending dispensing slot 31 in the semicylindrical wall 28. Again it is pointed out that a trash receptacle may have a receptacle for containing folded bags or a roll of flexible bags but will usually not include both types of containers.

Figure 2:
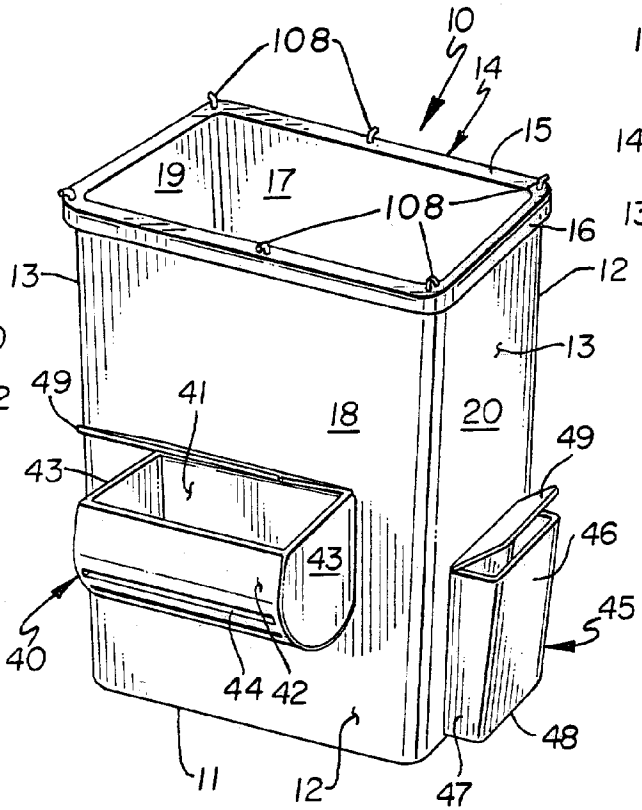
FIG. 2 is a perspective view of a different embodiment of the receptacle and container(s)

Referring now to FIG. 2, it will be seen that the trash receptacle 10 is provided with a container 40 which is attached to a side wall 12 in the manner of the embodiment of FIG. 1. It is also pointed out that the trash receptacle 10 illustrated in all of the Figures of the drawings are identical thereby obviating the need for a detailed description of each receptacle. The container 40 has an open top and includes a rear wall 41, a continuous curved bottom and front wall 42 and end walls 43. The curved bottom and front wall 42 has an elongate longitudinally extending dispensing slot 44 therein. The container 40 is shaped and sized to contain a roll of flexible bags which will be dispensed through the dispensing slot 44.

The trash receptacle 10 of FIG. 2 is also provided with a container 45 which is attached to an end wall 13 in the manner of the attachment of the container 26 in the embodiment of FIG. 1. It is also pointed out that all of the various embodiments of the containers will be formed of a rigid material which may be a polymer or rubberlike material compatible with the material forming the trash receptacle 10.

The container 45 has flat side walls 46, end wall 47, a bottom wall 48 and a lid 49 for closing the open top of the container. The container 45 is shaped and sized to contain a supply of folded flexible bags which will be removed through the open top. It is again pointed out that while the trash receptacles may have two containers, as illustrated in FIGS. 1 and 2, in most instances, each trash receptacle will have only one type of container.

Figure 3:
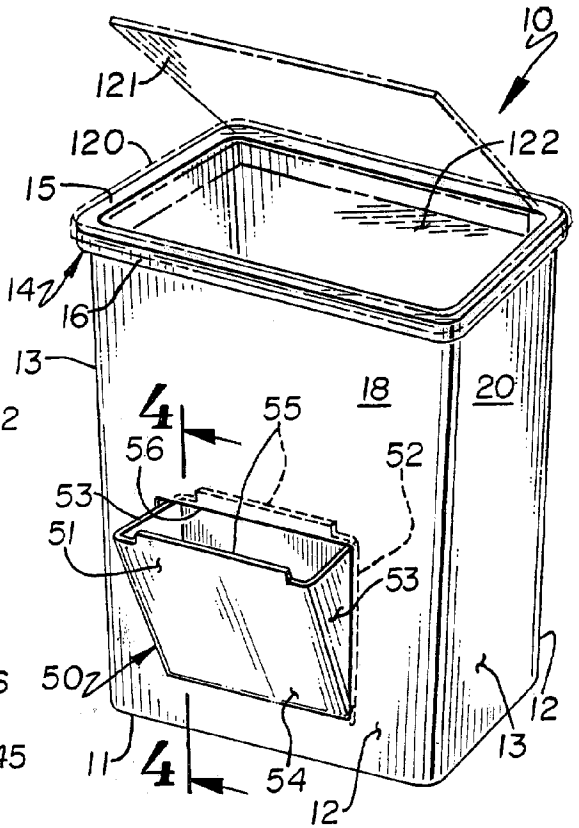
FIG. 3 is a perspective view of another embodiment of the receptacle and container.
Figure 4:
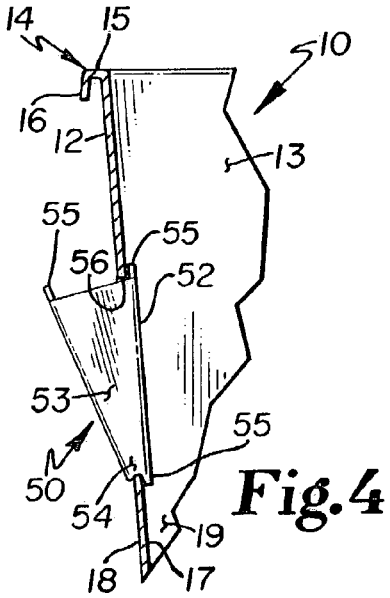
FIG. 4 is a cross-sectional view taken along line 4—4 of FIG. 3 and looking in the direction of the arrows.

Referring now to FIGS. 3 and 4, it will be seen that another embodiment of the container, designated generally by the reference number 50, is shown attached to a receptacle 10. The container 50 includes a front wall 51, a rear wall 52 and opposed end walls 53 which taper downwardly and terminate in a small bottom wall 54. One of the side walls 12 of the receptacle 10 has a rectangular opening 56 therein. The rear wall 52 has outturned flanges 55 extending vertically from the upper and lower edges thereof. The flanges 55 engage the upper and lower peripheral edge portions defining the opening 56.

With this arrangement, the container may be readily removed and readily attached to the trash receptacle. The container 50 has an open top and is shaped and sized to contain a supply of folded flexible bags which will be dispensed through the open top.

Figure 6:
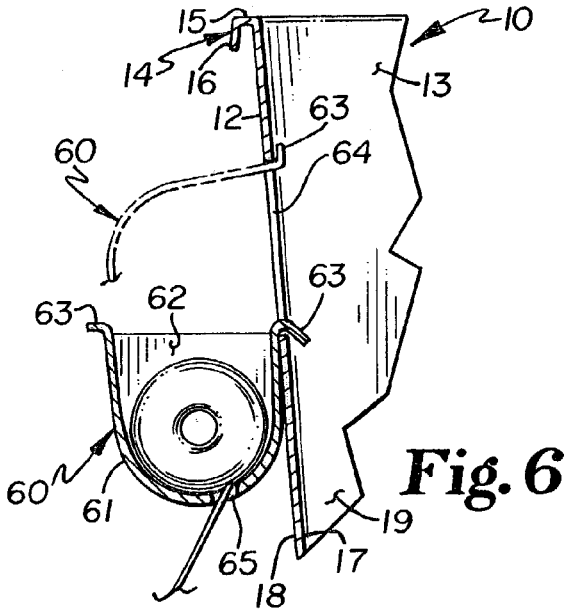
FIG. 6 is a cross-sectional view taken along line 6—6 of FIG. 5 and looking in the direction of the arrows.
Figure 5:
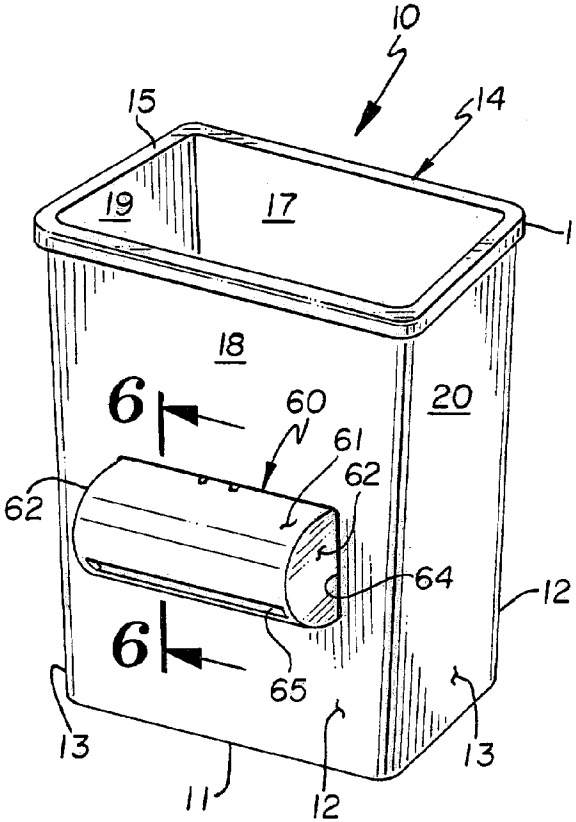
FIG. 5 is a perspective view of a further embodiment of the receptacle and container.

Referring now to FIGS. 5 and 6, it will be seen that a further embodiment of the container is thereshown. The container 60 is of trough-shaped configuration and includes a curved generally U-shaped wall 61 and end walls 62. The U-shaped wall 61 has outturned flanges 63 extending therefrom. The trash receptacle 10 has a generally rectangular shaped opening 64 in a side wall thereof. The outturned flanges engage the upper and lower peripheral edge portions defining the opening in the side wall 12 to secure the container to the receptacle in a closed position.

The container 60 is shaped and sized to contain a roll R of flexible bags which will be dispensed through an elongated substantially straight dispensing slot 65 in the U-shaped wall 61. Referring to FIG. 6, it will be seen that the container 60 may be supported from a single flange 63 thereby disposing the open side of the container upwardly. This open position of the container facilitates loading of the roll of bags into the container.

Figure 7:
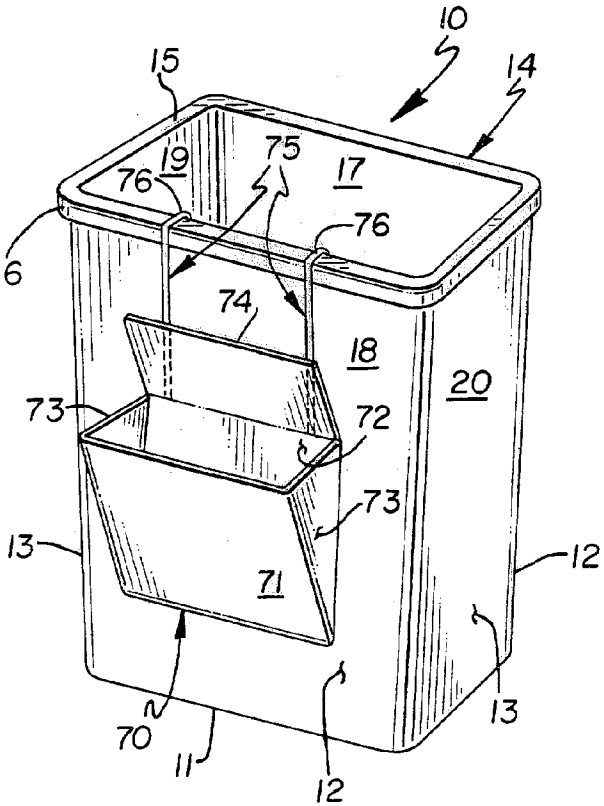
FIG. 7 is a perspective view of another embodiment of the receptacle and container.

Referring now to FIG. 7 of the drawings, it will be seen that another embodiment of the container is thereshown. The container 70 includes a front wall 71, a rear wall 72 and end walls 73 which taper downwardly. The front and rear converge downwardly and are joined along their respective lower edges. The container 70 has an open top which is closed by a lid 74 hingedly connected to the rear wall 72.

The container 70 is shaped and sized to contain a supply of folded flexible bags which will be dispensed through the open top. Means are provided for securing the container to the trash receptacle 10. This means includes a pair of laterally spaced apart elongate, vertically disposed rigid elements secured to the rear surface of the rear wall 72. The upper end portions of the attachment elements 75 are shaped to define hooks 76 which engage the upper peripheral edge of a side wall 12. The container 70 may therefore be readily attached or removed from the receptacle.

Figure 8:
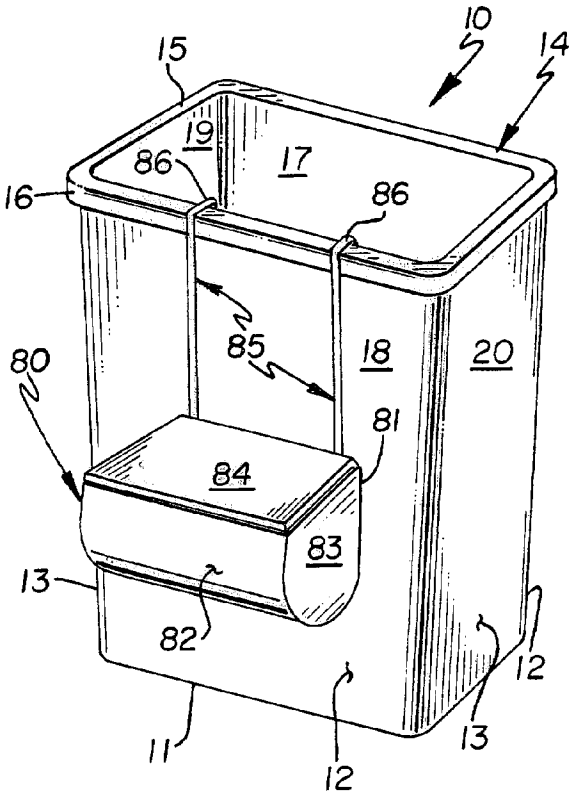
FIG. 8 is a perspective view of a further embodiment of the receptacle and container.

Referring to FIG. 8, a further embodiment of the flexible bag container for a trash receptacle is thereshown. The container 80 includes a flat rear wall 81, a curved lower and front wall 82, opposed end wall 83, and a lid 84 for closing the open top of the container. A pair of elongate attachment elements 85 are secured to rear surface of the rear wall 81 in the manner of the attachment elements of the embodiment of FIG. 8. The upper end portions of the attachment elements 85 are shaped to define hooks which engage the upper peripheral edge of a side wall to suspend the container from the receptacle 10.

The container 80 is shaped and sized to contain a roll of flexible bags which will be dispensed through an elongate, transversely extending dispensing slot 87 in the curved lower and front wall 82.

Figure 9:
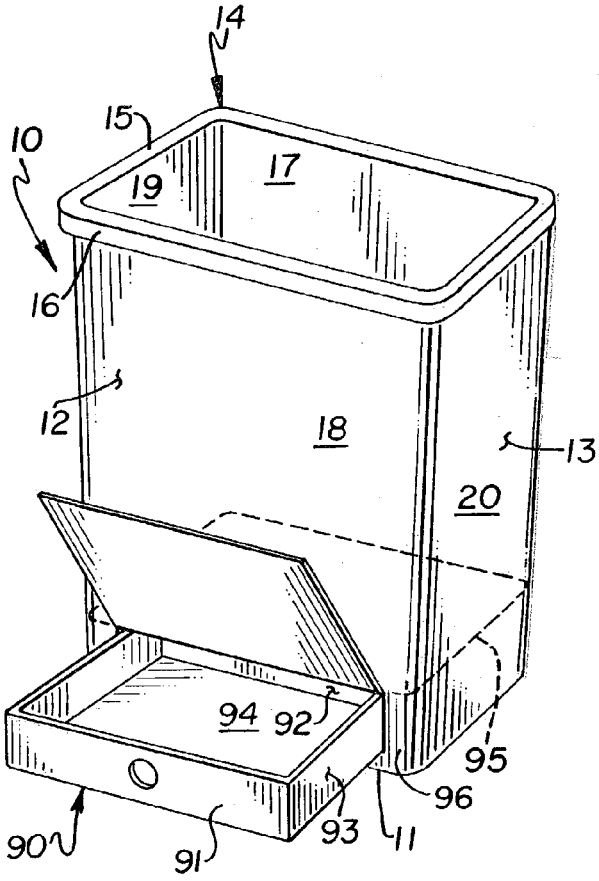
FIG. 9 is a perspective view of another embodiment of the receptacle and container.

Referring to FIG. 9, another embodiment of the flexible bag container for a trash receptacle is thereshown. The container 90 is of generally rectangular shape and includes a front wall 91, a rear wall 92, opposed end walls 93 and a bottom wall 94. The trash receptacle 10 is provided with a false bottom 94 which cooperates with the bottom wall 11 of the receptacle to define a compartment 96. The container 90 actually constitutes a drawer for containing a supply of folded flexible bags. The drawer or container is slidable into and out of the compartment 96. The container is thereby concealed when it is disposed within the compartment 96.

Figure 10:
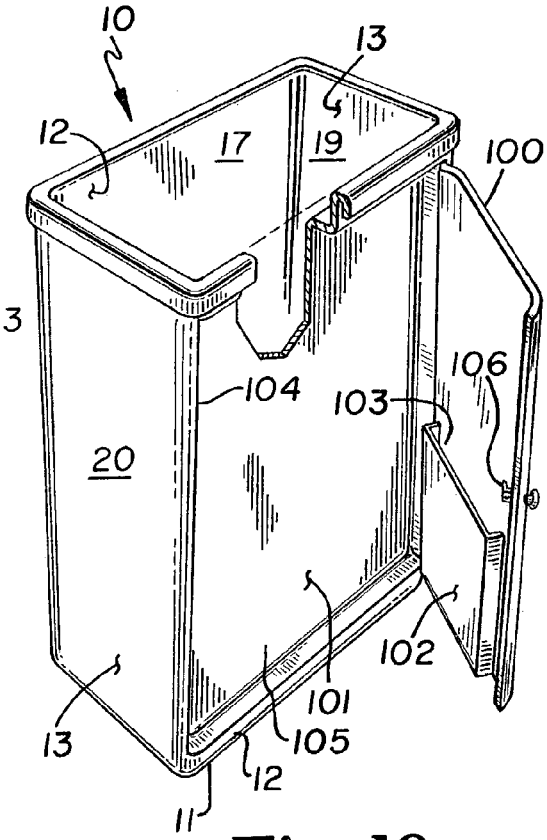
FIG. 10 is a perspective view of a further embodiment of the receptacle and container with certain parts thereof broken away for clarity.

Referring now to FIG. 10, another flexible bag container for a trash receptacle is thereshown. The receptacle 10 is provided with a door 100 which defines the outer surface of one side wall. The door is hinged to the receptacle and is swingable between open and closed positions. When the door 100 is in the closed position, the receptacle 10 has the appearance of a conventional trash receptacle. When the door 100 is in the open position, it will be seen that an open top container, 102 for flexible trash bags is secured to the inner surface of the door.

The container 102 provides storage for folded flexible bags which are removed therefrom through an upwardly facing opening 103. The receptacle 10 has a false (inner wall) wall 101 which cooperates with the door 100 to define a compartment 105 which accommodates the container 102 when the door is in the closed position. It is pointed out that although the door is attached to the receptacle and actually defines a sidewall of the receptacle, the door could also be attached to and define one of the end walls.

Reference is made again to FIG. 2 where the outturned flange of the upper peripheral edge is provided with a plurality of spaced apart attachment or hook elements 108. The upper peripheral edge portion of a flexible trash bag will be provided with openings therein through which the hook elements project for retaining the flexible trash bag as a liner for the receptacle. It is pointed that the retaining elements are illustrated with the embodiment of FIG. 2 but is not intended to be used only with this receptacle and the associated containers. The hook elements may be used with any or all of the embodiments shown.

Referring again to FIG. 3, it will be seen that the receptacle 10 is provided with a lid 120 which is illustrated in phantom line configuration. The lid 120 frictionally engages the upper peripheral edge of the receptacle to close the receptacle. The cover is readily removable from the receptacle to permit application of flexible bag and access to the interior of the receptacle. The lid 120 is also provided with a cover 121 hingedly connected thereto for closing a compartment 122 formed in the lid 120. The lid 120 has a upwardly concave configuration and the compartment 122 is intended to contain folded flexible trash bags. The lid 120 has the dual function of closing the receptacle 10 and providing readily accessible compartment for flexible bag.

It is again pointed out that the compartmented lid 120 may be used with any receptacle having any of the species of containers. Thus the compartmented lid is not intended to be restricted to receptacle and container of FIG. 3. The compartmented lid is also intended to be used with a receptacle 10 having no other trash bag container.

From the foregoing it will be seen that I have provided a trash receptacle with a container which contains a supply of flexible garbage bags used as a liner for the receptacle. In certain embodiments, the container is permanently attached to the trash can or receptacle, and in other embodiments the container may be removed from the trash receptacle. Only minor modifications are required to be made to the trash receptacle in certain embodiments of the container.

Thus it will be seen that I have provided a novel and efficient flexible bag container for trash cans.

What is claimed is:

1. An open top trash receptacle having a flat bottom wall and a vertical wall structure integral with said bottom wall and extending upwardly therefrom, the vertical wall structure including flat end walls and opposed side walls, the vertical wall structure having an upper peripheral edge having an outturned flange disposed in a plane substantially parallel to the bottom wall, a trash bag container shaped and sized for containing a supply of flexible trash bags, the open top of said trash receptacle being sized to accept insertion of a trash bag which is adapted to line the receptacle and wherein the upper peripheral edges and the outturned flange of said trash receptacle are adapted to accept the folded over mouth of the trash bag, said trash bag container having front and rear walls, means connecting the rear wall of the trash bag container to the receptacle to position the rear wall of the container in abutting contacting relation with a side wall of the receptacle, said container being positioned substantially below the upper peripheral edge of the receptacle and spaced above the bottom of the receptacle, said trash bag container having an open top therein for access to the flexible trash bag for selectively dispensing bags, and a lid hinged to a wall of the trash bag container for closing the open top of the container.

2. The receptacle as defined in claim 1 wherein said means connecting the container to the receptacle comprises adhesive means securing the container to the exterior surface of the vertical wall structure.

3. The receptacle as defined in claim 1 wherein said side and end walls of the trash receptacle and said rear wall of the trash bag container are of imperforate construction.

* * * * *